United States Patent [19]

Thim

[11] 4,290,991

[45] Sep. 22, 1981

[54] METHOD OF MANUFACTURING CONCRETE SLEEPER BLOCKS AND A MATRIX ARRAY FOR CARRYING OUT THE METHOD

[75] Inventor: Stig Thim, Växjö, Sweden

[73] Assignee: A-Betong AB, Växjö, Sweden

[21] Appl. No.: 95,718

[22] Filed: Nov. 19, 1979

[30] Foreign Application Priority Data

Dec. 5, 1978 [SE] Sweden ..... 7812505

[51] Int. Cl.[3] ..... B28B 23/06

[52] U.S. Cl. ..... 264/157; 249/86; 264/228; 264/297; 425/111

[58] Field of Search ..... 425/111; 264/228, 157, 264/297; 249/86

[56] References Cited

U.S. PATENT DOCUMENTS

| | | | |
|---|---|---|---|
| 4,038,355 | 7/1977 | Bratchell | 425/111 X |
| 4,102,957 | 7/1978 | Dare | 425/111 X |
| 4,105,739 | 8/1978 | Dave | 264/228 X |
| 4,204,660 | 5/1980 | Feuillade | 249/86 |

*Primary Examiner*—Thomas P. Pavelko

*Attorney, Agent, or Firm*—Sughrue, Mion, Zinn, Macpeak and Seas

[57] ABSTRACT

In a method of manufacturing for a railway switch-point concrete sleeper blocks (15') of varying lengths and having different number of attachment means (15'b) located in mutually different positions for the attachment of rails to said blocks there is used a plurality of steel matrices (2) whose respective lengths correspond to the desired lengths of the various sleeper blocks and which exhibit detachably mounted dowels (3). The matrices are placed end to end in an elongate mould bed with the dowels facing upwardly, whereafter reinforcing lines (5) are tensioned and concrete is cast into the mould bed and permitted to harden. The thus formed coherent concrete body (15), whose length may exceed 30 meters, is then removed from the mould and the matrices (2) removed and the dowels (3) remaining cast in the concrete block. The concrete body (15) is then cut into sleeper blocks (15') of desired length. The same matrices (2) can be used for the manufacture of sleeper blocks for both left-hand and right-hand switch-points, said matrices being turned and the dowels (3) being mounted on different sides of the matrices in the two cases.

The invention also relates to a matrix array for use in the described method. Each matrix is provided on both sides thereof with mirror-image markings which provide a clear print in the finished sleeper block, said imprint indicating the type of switch-point intended and the sequence number of a respective block among the sleeper blocks associated with said switch-point.

The sleeper blocks and rails associated with a particular railway switch-point can be assembled together, transported to and placed on the site in question along a railway track while using conventional track-laying machines.

5 Claims, 7 Drawing Figures

1
1A
1B
2
2a
2b
3
4
4a
5
6
7
8
9
10
11
12

METHOD OF MANUFACTURING CONCRETE SLEEPER BLOCKS AND A MATRIX ARRAY FOR CARRYING OUT THE METHOD

The present invention relates to a method of manufacturing concrete sleeper blocks having varying lengths and being intended for railway switch-points, said sleeper blocks being provided with means for attaching rails thereto, the number of said attachment means and their respective locations on said blocks varying from block to block.

Methods by which the manufacture of concrete sleepers for railway lines can be automated to a relatively high degree have previously been proposed in the art. This automation of the manufacture of concrete sleepers for railway lines has been made possible by the fact that all the sleepers are of substantially the same size and shape, and by the fact that the means for attaching the rails to the sleepers have been located in mutually the same positions on the respective sleepers.

Hitherto, the rail-attachment means have not been cast in concrete sleeper blocks for switch points in the manufacture of said blocks. Instead, so-called pandrol attachment or like attachment techniques have been used, said technique requiring holes for accommodating the attachment means to be drilled in the sleepers on site, whereafter the attachment means are mounted and secured with an epoxy adhesive. This method, however, cannot always be relied upon to provide a positive attachment, since the strength of the attachment depends on how successful the gluing operation has been, the person carrying out the work and on other conditions associated with the carrying out of the operation. The method is also expensive to put into effect.

An attempt to automate the manufacture of concrete sleeper blocks for railway switch-points immediately leads to a multiplicity of difficultly resolved problems. One of the main problems in this respect is that even the most simple type of switch-point requires a large number of sleeper blocks, each of which is different in some respects from another. For example a certain type of switch-point requires 61 sleeper blocks, of which not less than 58 differ from remaining sleeper blocks in one or more respects. Thus, there are differences with respect to the length of the blocks, these differences varying between about 1.5 and about 5 meters or more; differences with respect to the position and the number of attachment means required for mounting the rails on said blocks; differences in the provision and position of grooves and channels in respective blocks for accommodating electrical conductors; and the provision on certain blocks of means for mounting operating means for the movable parts of the switching-point; etc.

Another difficulty with respect to the automation of the manufacture of concrete sleeper blocks for railway points is that the pre-stressed concrete which must be used in order for the block to obtain the required mechanical strength contracts whilst hardening and detensioning, said contraction varying with different sleeper blocks as a result of their differences in length. It will be understood in this respect that it is of the utmost importance that all bolt holes obtain their correct final position in respective sleepers. Thus, one single faulty sleeper can jeopardize the laying of a complete switch-point, which would naturally incur particularly high costs, not least as the result of the complicated and expensive machinery required for the laying operation.

Another complicated factor in the present context is that the attachment means may obtain different positions in left-handed and right-handed switch-points.

Because of the aforementioned circumstances concrete sleepers have not hitherto been used for railway switch-point. Instead wooden sleepers have often been used for switch-points, even though concrete sleepers have been used for the remainder of the track. It will be readily understood that such a discontinuity is highly unsatisfactory and that consequently a successful solution to the problem of manufacturing concrete sleepers for railway switch-points would afford a large number of advantages.

The present invention relates to a method of manufacturing concrete sleeper blocks for railway switch-points on a factory scale and in a rational manner which enables the necessary individual variations between different sleeper blocks to be obtained with great accuracy and precision.

The method according to the invention is mainly characterized in that a plurality of thin matrices whose length corresponds to the length of the various sleeper blocks and which exhibit removably mounted attachment means, are placed end to end in an elongate mould with the attachment means extending upwardly, that reinforcing means such as ropes are tensioned in the mould, that concrete is cast in the mould and permitted to harden, that the cured coherent concrete body is removed from the mould and the matrices removed from the concrete body and the attachment means cast therein, and that the concrete body is cut into lengths corresponding to the desired sleeper blocks.

A basic feature of the invention is that there is used a plurality of matrices of precise dimensions and that the attachment means can be mounted in exact positions while taking into account the shrinkage experienced by the concrete block during the hardening period.

The placing of the matrices in an elongate mould enables casting to be carried out in an effective and efficient manner with the simultaneous casting of a plurality of coherent sleeper blocks in the form of a concrete body having, for example, a length of 30 meters or more. Thus, during the de-moulding operation and the subsequent handling and transport of the sleeper blocks to the cutting station, all the sleeper blocks can be handled as a single unit in the form of said concrete body, which is thus of considerable length.

It will be understood that the method affords a large number of advantages, for example with regard to the tensioning of reinforcing means, i.e. the reinforcing ropes and the actual casting operation, and is superior to a method in which the sleeper blocks are cast individually in separate moulds.

A further possibility to the rationalization of the manufacture of such blocks is afforded by the fact that the mould bed may comprise two or more mutually adjacent parallel mould cavities for moulding substantially simultaneously a corresponding number of elongate concrete bodies. Thus, in this respect the same rope-tensioning carriage can be used for placing the reinforcing ropes in all the mould cavities. Further, abutment plates common for all reinforcing ropes and associated spacer plates can be used both with the active abutments of the mould and its passive abutments. Further, there can be used a common winch for tensioning and drawing the reinforcing ropes, and a common tensioning means for the abutment plate at the active abutment.

In addition, the casting of a plurality of sleeper blocks in a mould to form a single coherent concrete body affords the advantage whereby a satisfactory sleeper block with regard to quality and appearance is obtained in conjunction with the casting operation, thereby reducing subsequent treatment to a minimum. The concrete block can be cut precisely and rapidly into desired lengths by means of a diamond saw, so that the cut surfaces of the block obtain a high surface finish. The material lost when cutting the block is, to all practical purposes, of no significance.

Preferably, in practice the concrete body is lifted out of the mould bed and turned before removing the matrices.

Removal of the block from the mould can be effected, for example, by means of an overhead crane, care being taken when lifting the hardened concrete body from the mould. Removal of said block from the mould, however, can be effected in any other suitable manner. Thus, for example, it is possible to use a vertically movable mould bed which, for example, is lowered when removing said body from the mould, whereafter the coherent concrete body is transported away in a suitable manner, conveniently after first having been turned to facilitate removal of the matrices. It is, of course, also possible to remove the matrices without first turning the concrete body.

In order to facilitate cutting of the block, a transverse strip, e.g. a plastics strip, is conveniently placed between consecutive matrices in the mould bed, said strips providing an indication as to where the block shall be cut.

Preferably an edge reinforcement and cleave reinforcement in the form of a wire is wound around the reinforcing ropes at the ends of the various matrices prior to the casting operation. The mechanical strength properties of the finished sleeper blocks is improved in this way. In addition, attachment means, e.g. in the form of pairs of encircling stirrup-like structures, are mounted in the mould in order to avoid damage during manufacture.

Individual variations in the various sleeper blocks can be provided by introducing into the mould bed prior to the cutting operation different types of so-called "dummies" intended to form in the finished sleeper blocks suitable recesses, e.g. through which electrical conductors can be drawn. The matrices can thus conveniently be provided with suitable markings indicating the suitable position for such dummies.

When using matrices in accordance with the invention, the important advantage is afforded whereby the same matrices can be used for manufacturing sleeper blocks both for left-hand and right-hand railway switching-points, said matrices being turned and the attachment means applied to one side of the matrix when manufacturing sleeper blocks for right-hand points, and on the other side when manufacturing sleeper blocks for left-hand points.

To make this possible, the matrices are preferably provided with through-passing holes which are used when mounting the attachment means in one or the other of said directions. The sleeper blocks thus produced will be mirror images of each other.

To facilitate both the actual manufacturing process and the final handling of the finished sleeper blocks, it is preferred that the two sides of the matrices are provided with such markings (mirror-turned) that it can be seen on the upper surface of the finished sleeper blocks, thereby to indicate the type of switch-point concerned and the sequence number of a block in the sleeper blocks belonging to a switch-point. To this end all matrices are provided on both sides with a marking plate, providing in the finished sleeper block a clearly visible and understandable simple and reliable code system.

The invention also relates to a matrix array for the manufacture of concrete sleeper blocks for railway switch-points, said array being substantially characterized by a plurality of separate matrices in the form of substantially planar disks or plates having substantially the same width corresponding to the upper surface of the sleeper block and varying lengths corresponding to the desired lengths of separate sleeper blocks, and being provided with holes located at pre-determined varying positions for the removable application of attachment means intended to be cast in the concrete sleeper blocks.

In accordance with the above, the matrices suitably comprise planar disks or plates made of steel and suitably having a thickness of about 5 mm.

The holes in the matrices are preferably through-passing holes, thereby to enable the attachment means to be readily mounted on one side for the manufacture of sleeper blocks for left-hand switch-points, and on the other side for the manufacture of sleeper blocks for right-hand switch-points.

The attachment means are suitably removably mounted by means of bolts of the same dimensions as those bolts used for attaching rails to the cast sleeper blocks.

The total length of the attachment means, optionally including the associated attachment bolts, preferably somewhat exceeds the thickness of the sleeper block, so that through-passing holes are formed in the sleeper blocks for drainage purposes.

This affords the advantage whereby water collected in the bolt holes is allowed to drain off before the rail-attachment bolts are screwed in.

The bolts used for removably mounting the attachment means to the matrices are preferably somewhat longer than said matrices, the end of said bolts extending from said matrices being plain (i.e. not threaded) and suitably having a conical shape. In practice the bolts are suitably of a special design and include a screw-threaded portion and a rod-like extension anchored thereto, said extension exhibiting said conical portion.

An exemplary embodiment of the invention will now be described with reference to the accompanying, partly schematic drawings.

Figures 1, 2:
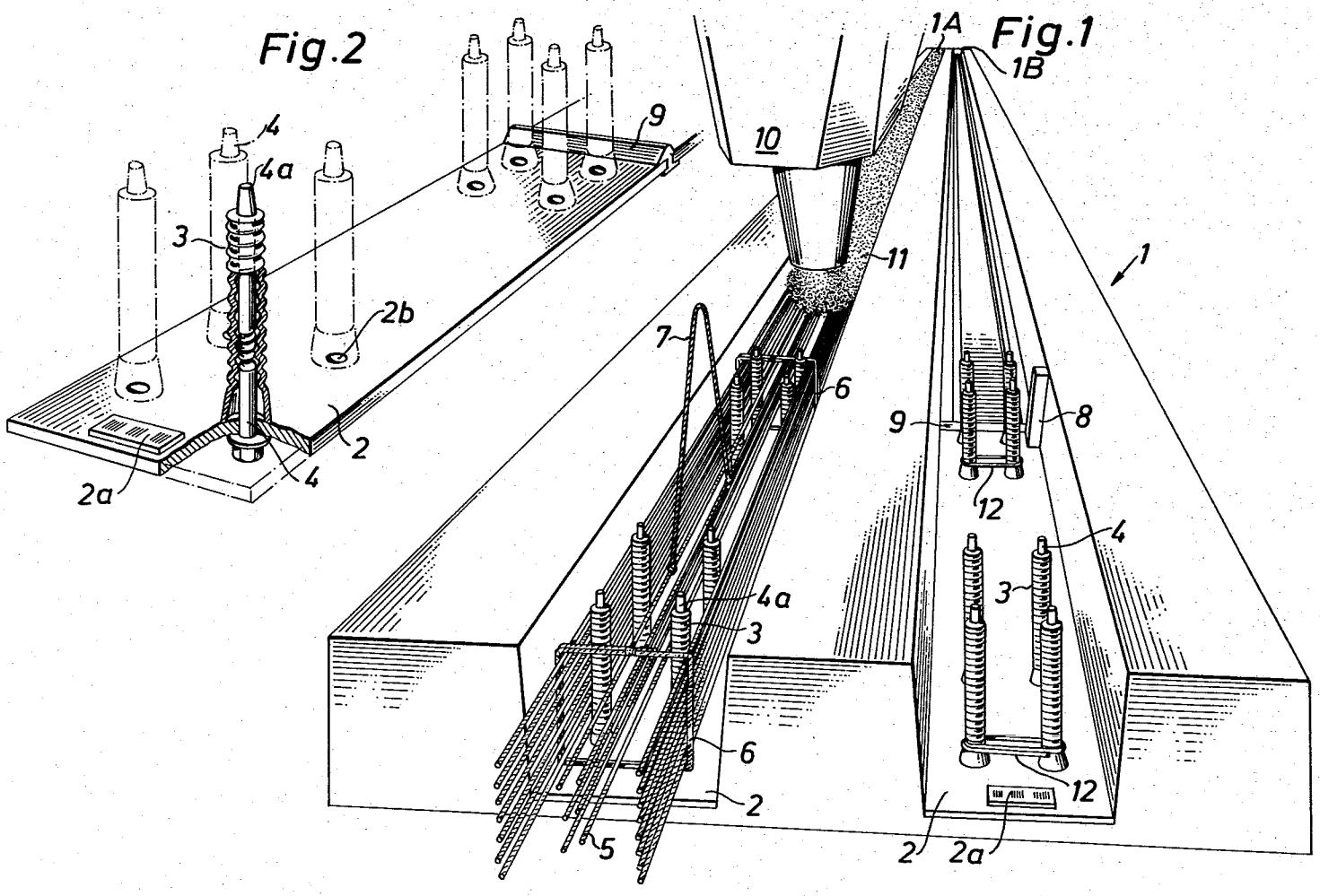
FIG. 1 is a perspective view of a mould having two mutually adjacent parallel mould cavities for manufacturing concrete sleeper blocks for railway switch-points.
FIG. 2 is a perspective view illustrating a matrix with attachment means mounted thereon, said attachment means having the form of so-called dowels on the side of a matrix of similar type to that inserted in the mould cavity illustrated in FIG. 1.

In FIG. 1 there is illustrated a mould bed 1 having two parallel adjacent mould cavities 1A and 1B intended for casting two coherent concrete bodies, which are subsequently to be cut into sleeper blocks for a railway switching-point.

The mould bed suitably has a length of, for example, 32 m and assuming that the average length of the finished sleeper blocks is from 2 to 3 meters, about 10 to 16 sleeper blocks can be simultaneously cast in each of the mould cavities.

If it is also assumed that a complete switch-point includes about 60 sleeper blocks—of which the majority exhibit mutually different variations with respect to length and/or the position of and number of attachment means—it will be seen that in order to manufacture all the sleeper blocks required for such a switch-point in a mould having two mould cavities of the aforementioned type, at least two complete casting cycles are required with associated preparation of the mould, hardening of the cast concrete and subsequent de-moulding.

The two mould cavities 1A and 1B illustrated in FIG. 1 are intended for upward and downward sleeper manufacture and accommodate a plurality of mutually adjacent thin steel matrices which are introduced into the bottom of respective cavities and which are provided with upwardly extending attachment means in the form of screw-threaded dowels. The general form of the matrices 2 and the dowels 3 can be seen from FIG. 2. Each of the matrices has on one end thereof a marking plate 2*a* with a mirror-image marking which indicates the kind of switch-point in question and the sequence number for the concrete sleeper to be cast while using the matrix.

In the left mould cavity 1A shown in FIG. 1 there has been introduced a plurality of reinforcing rods 5 and arranged in the region of the ends of respective matrices is a wire 6 which embraces the reinforcing rods and which is intended to form an edge and cleavage reinforcement in the finished sleeper blocks.

Shown in the mould cavity 1A is a lifting eye 7 for the finished concrete body, and in mould cavity 1B a stirrup 12 which is passed around two adjacent dowels. The lifting eye 7 is mounted at one of the reinforcing rods 5. Arranged between adjacent matrices 2 is a strip 9, which may be made of a plastics material, which indicates where the block shall be cut.

Arranged in the right mould cavity 1B in FIG. 1 is a dummy 8 intended to form a corresponding cavity in the finished sleeper block, e.g. a cavity which facilitates the arrangement of electrical conductors in said block.

FIG. 1 also illustrates part of a casting machine 10 arranged to pour concrete 11 into the mould cavity 1A.

Figure 3:
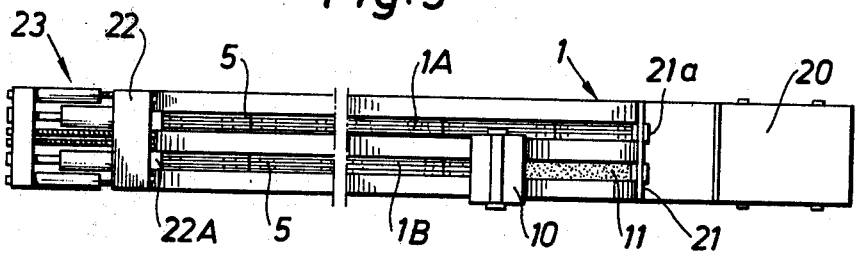
FIG. 3 is a plan view of a mould according to FIG. 1, with both mould cavities prepared for casting, with concrete being cast in one of said cavities.

FIG. 3 is a plan view illustrating further elements associated with a mould arrangement of the kind illustrated in FIG. 1. Corresponding elements have been identified with the same references in the two figures. In the view shown in FIG. 3, reinforcing rods 5 have been tensioned in both mould cavities 1A and 1B, and the casting machine 10 is laying a stream of concrete in the cavity 1B.

The reinforcing rods are drawn from a carrier (not shown) by means of a carriage 20 movable on rails along the side edges of the mould, with the aid of a winch (not shown) located to the left of the mould arrangement shown in FIG. 3. Subsequent to drawing the reinforcing rods, the ends of the rods are connected to abutment plates 21*a* and 22*a* in the region of the passive and active abutments 21 and 22, respectively of the mould. A tensioning means 23 including a plurality of hydraulic cylinders co-operates with the active abutment 22. The arrangement is such that all reinforcing rods in the two mould cavities are tensioned simultaneously prior to the commencement of a casting operation and are also relieved simultaneously subsequent to the concrete hardening.

The mould equipment also includes a work table (not shown) for mounting the dowels 3 in the matrices 1. Mounting of the dowels is effected with the aid of special, partially screw-threaded bolts 4 which are passed through holes 2*b* arranged in the matrices, in positions which have been carefully calculated. The length of the bolts 4 is greater than that of the dowels 3 and the ends 4*a* (FIG. 2) of the bolts extending from the dowels are of conical configuration and lack screw-threads. The total length of the bolts is such that through-passing holes are formed in the finished sleeper blocks.

Figure 4:
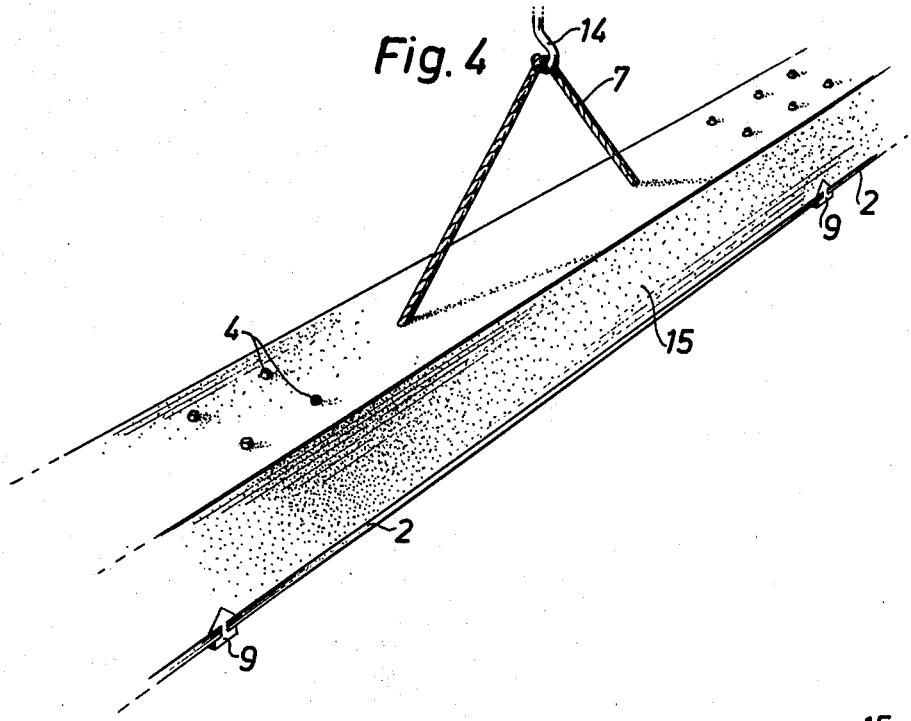
FIG. 4 is a perspective view of a part of coherent concrete body cast in a mould according to FIGS. 1 and 3, said body being shown subsequent to removing it from said mould and during its transportation to a receiving station.
Figure 5:
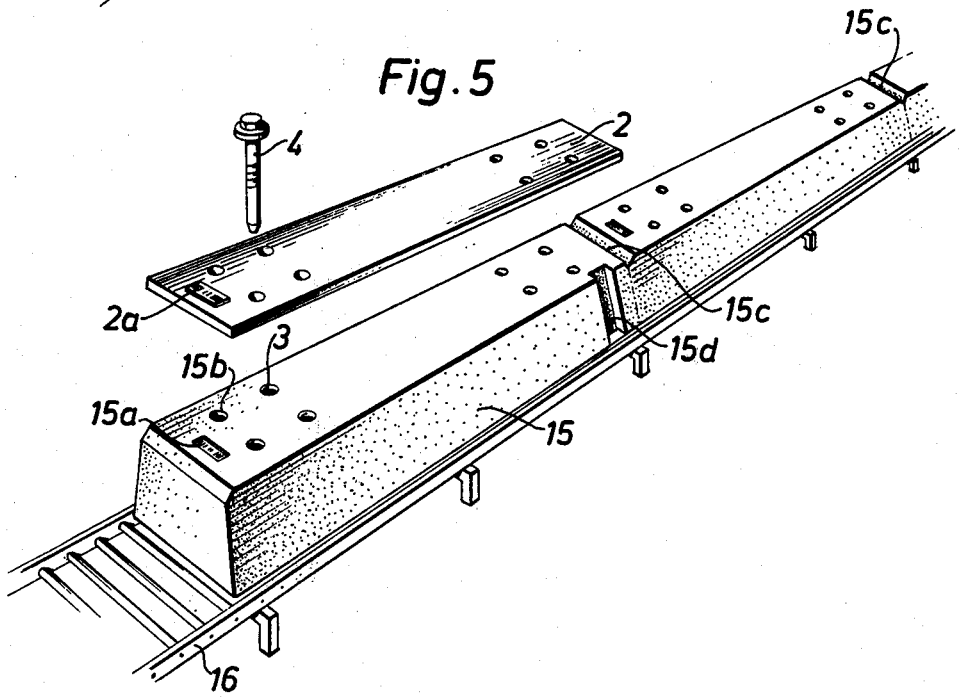
FIG. 5 is a perspective view of a concrete body according to FIG. 4 subsequent to arriving at said receiving station and being turned therein, and illustrating said body during the removal of a matrix.

FIG. 4 illustrates a hardened, coherent concrete body 15 subsequent to removing said body from the mould, said body being shown during its transport to a receiving table 16 shown in FIG. 5, by means of a crane hook 14 engaging the lifting eye 7.

FIG. 5 further illustrates that the concrete body 15 has been turned on the table 16 and that the matrices 2 can be removed subsequent to removing the bolts 4. The screw-threaded plastics dowels 3 are thus cast exactly in the desired locations in the concrete body. The dowels 3 form upon removal of the bolts 4 tapped through-passing holes 15*b* in the concrete body 15.

FIG. 5 also shows that the matrices 2 are provided with marking plates 2*a* on both sides, the lower marking plate—which is not visible in FIG. 5—leaving an imprint 15*a* in the concrete body 15 which enables respective sleeper blocks to be identified.

FIG. 5 also illustrates cutting indications 15*c* formed by the strips 9, and a cavity 15*d* formed by the dummy 8 shown in FIG. 1.

Figure 6:
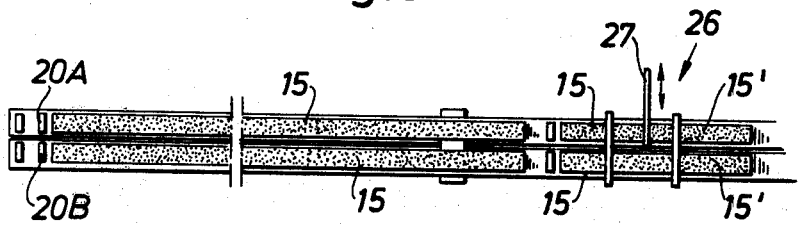
FIG. 6 is a plan view of two mutually adjacent parallel roller conveyors for the coordinate transport of cast concrete bodies to a diamond saw, for cutting said bodies into concrete sleepers of required length.

FIG. 6 illustrates two parallel, adjacent roller paths 20A and 20B arranged in connection with a cutting station 6, in which a diamond saw 7 is movable transversely of the concrete bodies, said saw being arranged to cut finished sleeper blocks 15′ (FIG. 7) from said bodies 15. FIG. 6 illustrates the final cutting step for two concrete bodies 15, while two further similar concrete bodies await their turn to be cut.

Figure 7:
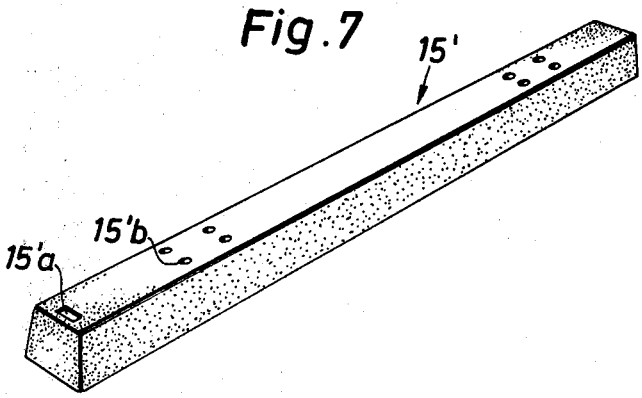
FIG. 7 illustrates a concrete sleeper manufactured by means of the method illustrated in the above mentioned figures.

FIG. 7 illustrates a finished sleeper block 15′ ready to be delivered together with other sleeper blocks belonging to the manufactured railway switch-point, said blocks being of a nature such as to require no further manufacturing operations. At one end the sleeper block 15′ has an identification imprint 15′*a*. Further, it comprises eight tapped holes 15′*b* adapted to receive corresponding bolts (not shown) for mounting rails (not shown) on the sleeper block.

I claim:

1. A method of manufacturing concrete sleeper blocks for the construction of a railway switching point, comprising:

(a) providing a plurality of thin matrices having differing lengths corresponding to the desired lengths of differently dimensioned sleeper blocks required for the construction of a given switching point, (b) detachably mounting a variable plurality of upwardly extending attachment means to each matrix point at variable positions thereon as between different matrices in accordance with predetermined design specifications, (c) placing the matrices in end to end abutment in an elongate mould bed, (d) disposing and tensioning a plurality of reinforcing rods longitudinally within the mould bed, (e) pouring concrete into the mould bed and allowing the concrete to cure, (f) removing the hardened coherent concrete body from the mould, (g) removing the matrices from said concrete body and the attachment means cast therein, and (h) cutting the concrete body into finished sleeper blocks of different desired lengths at the transverse lines of abutment between adjacent matrices.

2. A method according to claim 1, characterized by lifting the concrete body out of the mould bed and turning it before removing the matrices.

3. A method according to claim 2, characterized by arranging between two consecutive matrices a transverse plastics strip to form an indication where the concrete body is to be cut.

4. A method according to claim 3, characterized by using the same matrices for manufacturing sleeper blocks for both left-hand and right-hand switch-points, then applying the attachment means on one side of the matrix when manufacturing sleeper blocks for right-hand points and on the other side when manufacturing blocks for left-hand points.

5. A method according to claim 4, characterized by providing both sides of the matrices with markings such that the type of switch-point and the sequence number of respective blocks among the sleeper blocks associated with said switch-point can be clearly seen from the upper surface of said blocks.

* * * * *